United States Patent [19]

Kobayashi

[11] Patent Number: 4,754,969

[45] Date of Patent: Jul. 5, 1988

[54] SET OF GOLF CLUBS

[75] Inventor: Masashi Kobayashi, Matsudo, Japan

[73] Assignee: Maruman Golf Co., Ltd., Tokyo, Japan

[21] Appl. No.: 911,933

[22] Filed: Sep. 26, 1986

[30] Foreign Application Priority Data

Sep. 30, 1985 [JP] Japan ..... 60-214675

[51] Int. Cl.[4] ..... A63B 53/04

[52] U.S. Cl. ..... 273/77 A; 273/167 H; 273/78

[58] Field of Search ..... 273/77 A, 173, 167 H, 273/167 J, 78, 174, 169, 170, 171, 172, 175, 167 F, 77 R, 77 B

[56] References Cited

U.S. PATENT DOCUMENTS

| | | | |
|---|---|---|---|
| 1,359,220 | 11/1920 | Beamer | 273/78 |
| 2,447,967 | 8/1948 | Stone | 273/77 A |
| 4,023,802 | 5/1977 | Jepson et al. | 273/173 |
| 4,432,549 | 2/1984 | Zebelean | 273/167 H |
| 4,489,945 | 12/1984 | Kobayashi | 273/167 H |

FOREIGN PATENT DOCUMENTS

| | | | |
|---|---|---|---|
| 211781 | 12/1957 | Australia | 273/167 H |
| 59-193462 | 12/1984 | Japan | 273/77 A |
| 1554 | 1/1895 | United Kingdom | 273/78 |

*Primary Examiner*—George J. Marlo
*Attorney, Agent, or Firm*—Armstrong, Nikaido, Marmelstein & Kubovcik

[57] ABSTRACT

A set of golf clubs wherein each club head includes a closed hollow behind the striking face. The thickness of each striking face is gradually decreased as the length of each shaft is gradually increased.

4 Claims, 4 Drawing Sheets

SET OF GOLF CLUBS

BACKGROUND OF THE INVENTION

1. Field of the Invention

The present invention relates to a set of golf clubs, and more particularly, to an improvement of club-heads of a set of golf clubs.

2. Description of the Related Art

Generally, the direction of flight of a ball is determined by the orbit of a swing of a club-head just before the impact of the club-head with the ball and the direction in which the club-head is facing at the time of impact of the club-head with the ball. If the orbit of the swing of the club-head is not in alignment with an objective direction of flight of the ball just before the impact of the club-head with the ball, the direction of flight of the ball deviates from the objective direction. In turn, if the club-head is facing toward the left or right of the objective direction of flight of the ball at the time of impact of the club-head with the ball, the flight of the ball will be toward the left or right of the objective direction of flight of the ball.

As mentioned above, the direction of flight of the ball is influenced by the direction in which the club-head is facing or the orbit of the swing of the club-head, and this influence given by the direction in which the club-head is facing or the orbit of the swing of the club-head to the direction of flight of the ball is varied by the length of time the club-head is in contact with the ball. That is, when the contact time is short, the direction of flight of the ball only slightly affected by the swing orbit of the club-head, and a much greater affect is given by the direction in which the club-head is facing. Conversely, when the contact time is longer, the direction of flight of the ball is only slightly affected by the direction in which the club-head is facing, and a much greater affect is given by the swing orbit of the club-head.

Generally, golf players try to keep the face of the club-head perpendicular to the objective direction of flight of the ball when the ball is hit by the club-head, and to ensure that the swing orbit of the club-head conforms with the objective direction of flight of the ball just before the impact of the club-head with the ball. In this case, it is very difficult to control the direction in which the club-head is facing during the impact of the club-head with the ball, because the impact is effected in a very short time, but it is relatively easy to control the swing orbit of the club-head because the swing action of the golf club is effected in a relatively long time. Therefore, it is desirable to correct the swing orbit of the club-head in order to improve the direction of flight of the ball.

When using a conventional set of golf clubs, it has been shown that, generally, a mishit and a subsequent deviation of the direction of flight of the ball tend to occur more often with an increase in the length of the golf club used, because the club-shaft is twisted further and thus the club-head is more apt to face toward the left or right of the objective direction of flight of the ball at the time of the impact of the club-head with the ball.

Japanese Unexamined Utility Model Publication (Kokai) No. 59-193462 discloses a set of iron golf clubs in which the thicknesses of the face portions or ball-hitting portions of the club-heads are increased gradually in accordance with an increase of the club-lengths. In such a set of iron golf clubs, times that the club-heads are in contact with the ball during the impact therebetween are decreased in accordance with an increase of the thicknesses of the face portions of the club-heads, and it becomes more difficult to control the direction in which the club-head is facing in accordance with decrease in the time that the club-head is in contact with the ball, as described above. Therefore, such a set of iron golf clubs has a disadvantage in that the direction of flight of the ball is more apt to be deviated from the objective direction of flight of the ball in accordance with the increase of the club-length.

SUMMARY OF THE INVENTION

An object of the present invention is to provide a set of golf clubs in which the times that the club-heads of the golf clubs are in contact with a ball during an impact therebetween can be increased in accordance with an increase in the length of the golf clubs.

According to the present invention, there is provided a set of golf clubs comprising a series of golf clubs each having different lengths, the golf clubs having a club-head having a face portion for hitting a ball, and each of the face portions of the club-heads having a thickness determined so that the thicknesses of the face portions decrease gradually in accordance with the increase in the length of the golf clubs.

In the above-mentioned golf-club set according to the present invention, elasticities of the face portions of the club-heads increase in accordance with the decrease in the thicknesses thereof, and thus the times that the club-heads are in contact with the ball during impact of the club-heads with the ball increase in accordance with the increase in the length of the golf clubs. Therefore, in the golf-club set according to the present invention, the direction of flight of the ball, when hit by the club-head, is influenced more greatly by the swing orbit of the club-head, and the influence is increased in accordance with the increase in the length of the golf club. Consequently, according to the present invention, it is possible to eliminate the disadvantage of the conventional golf-club set wherein the deviation of the direction of flight of the ball from the objective direction of flight of the ball is influenced more in accordance with the increase in the length of the golf clubs, and to provide a golf-club set in which all of the golf clubs can easily cause a ball to fly in an objective direction.

Preferably, the face portion of the club-head of each of the golf clubs in the set according to the present invention is made of a springy material. Such a construction can increase the elasticity of the face portion of each of the club-heads, and thus increase the time that each of the club-heads is in contact with the ball during the impact therebetween.

More preferably, the club-head of each of the golf clubs in the set according to the present invention is a hollow metal head. In such a construction, it is possible to further increase the thicknesses of the rear portions of the club-heads in accordance with the decrease in the thicknesses of the face portions of the club-heads while maintaining a suitable total weight of each of the club-heads, and thus it is possible to further increase the depths of the positions of the centers of gravity of the club-heads from the face surfaces of the club-heads in accordance with the increase in the lengths of the golf clubs. It is well known that the deviation of direction of flight of the ball from the objective direction, when hit by the club-head, can be easily prevented by increasing the depth of the position of the center of gravity of the club-head. Therefore, it will be understood that the above-mentioned preferred construction of the golf-club set serves to prevent the deviation of direction of flight of the ball from the objective direction when the ball is hit by the golf clubs, particularly by the golf clubs having a long length.

BRIEF DESCRIPTION OF THE DRAWINGS

The foregoing and other features and advantages of the present invention will be more apparent from the following detailed description with reference to the preferred embodiments illustrated in the drawings; wherein.

DESCRIPTION OF THE PREFERRED EMBODIMENTS

Figure 1A:
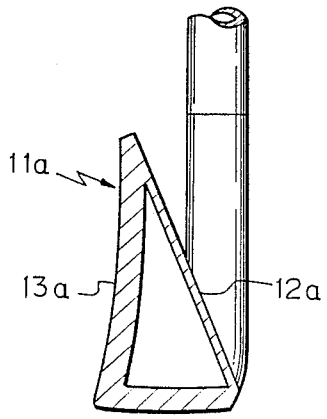
FIGS. 1*a* to 1*d* are cross-sectional views illustrating club-heads of iron-type golf clubs, respectively, which are a part of one set of iron-type golf clubs according to a first embodiment of the present invention.
Figure 1B:
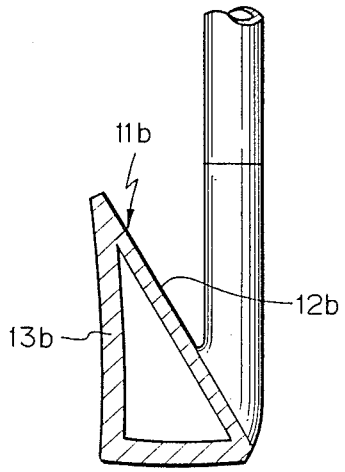
Figure 1C:
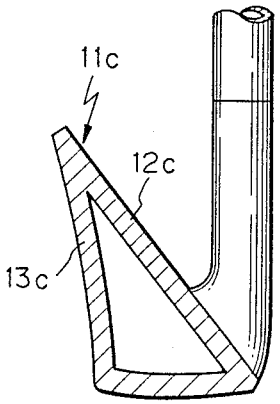
Figure 1D:
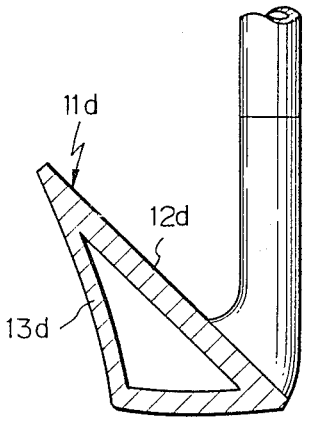

FIGS. 1*a* to 1*d* show club-heads 11*a* to 11*d* of iron-type golf clubs which are a part of one set of golf clubs according to a first embodiment of the present invention. FIG. 1*a* shows a club-head 11*a* of a long iron club (club-number 3) for obtaining a long flight distance of a ball; FIGS. 1*b* and 1*c* show club-heads 11*b* and 11*c* of middle iron clubs (club-numbers 5 and 7, respectively) for obtaining middle flight distances; and FIG. 1*d* shows a club-head lld of a short iron club (club-number 9) for obtaining a short flight distance. Generally, these iron clubs shown in FIGS. 1*a* to 1*d* are a part of one set of eight or nine iron golf clubs having varying club-numbers. The set of iron golf clubs may include, for example, iron clubs having club-numbers 2, 4, 6, and 8 other than the above-mentioned iron clubs shown in FIGS. 1*a* to 1*d,* and also may include pitching or sand wedges which correspond to iron golf clubs having club-numbers 10 and 11, respectively. In the set of the iron golf clubs, each iron club has a club-length determined so that the club-length decreases gradually or regularly in accordance with the increase in the club-number.

Referring to FIGS. 1*a* to 1*d,* the club-heads 11*a* to 11*d* of the iron clubs are hollow metal heads, each having therein a closed bore or closed hollow space. The club-heads 11*a* to 11*d* have face portions or front walls 12*a* to 12*d,* respectively, for hitting a ball, and rear portions 13*a* and 13*d.* Each of the club-heads 11*a* to 11*d* is made of a stainless steel by, for example, a lost-wax process. The material of each of the face portions 12*a* to 12*d* of the club-heads 11*a* to 11*d* is then changed into a springy material having a high elasticity by an annealing treatment.

As apparent from FIGS. 1*a* to 1*d,* the face portions 12*a* to 12*d* of the club-heads 11*a* to 11*d* have thicknesses which are determined so that the thicknesses decrease gradually or regularly in accordance with the increase in the club-length or decrease of the club-number. Therefore, elasticities of the face portions 12*a* to 12*d* of the club-heads 11*a* to 11*d* increase in accordance with the increase in the club-length. As the result, a time that the club-heads 11*a* to 11*d* are in contact with the ball during an impact therebetween becomes longer in accordance with the increase of the club-length.

Further, according to the above-mentioned construction of the set of iron clubs, it becomes possible to increase the weight of the rear portions 13*a* to 13*d* gradually or regularly in accordance with the decrease in the thicknesses of the face portions 12*a* to 12*d* of the club-heads 11*a* to 11*d* while keeping the total weight of the club-heads 11*a* to 11*d* the same as that of the conventional club-heads, respectively. Therefore, it becomes possible to gradually increase the depths of the positions of centers of gravity of the club-heads 11*a* to 11*d* from the face surface of the club-heads 11*a* to 11*d* in accordance with the increase in the club-length. Consequently, moments of inertia of the club-heads about the centers of gravity thereof in the club-heads 11*a* to 11*d* increase gradually in accordance with the increase in the club-length. As a result, when the ball is hit by a club-head of a long iron club, such as an iron club having a club-number 3 or 4, at a point which is deviated from a sweet spot of the club-head, it becomes possible to prevent a turning of the face portion of the club-head to a left or right, and thus it becomes easy to make the ball fly in a objective direction.

Figure 2A:
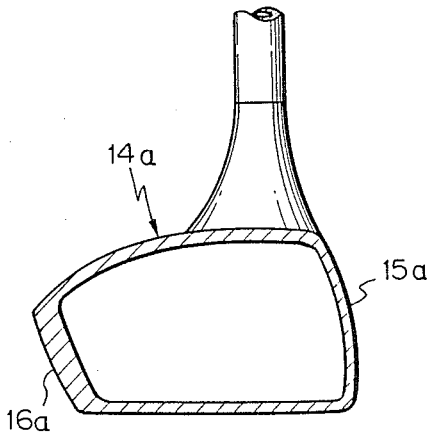
FIGS. 2*a* to 2*c* are cross-sectional views illustrating club-heads of wood-type golf clubs, respectively, which are a part of one set of wood-type golf clubs according to a second embodiment of the present invention.
Figure 2B:
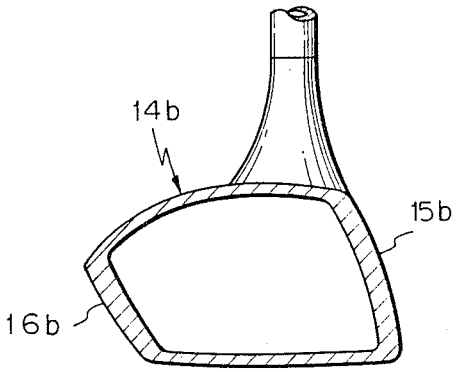
Figure 2C:
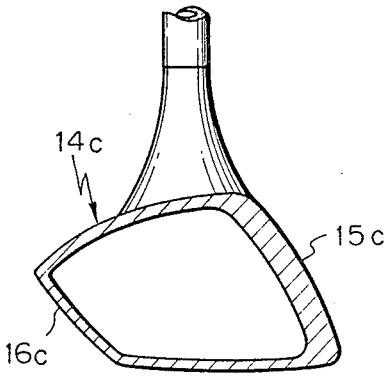

FIGS. 2*a* to 2*c* show club-heads 14*a* to 14*d* of successive wood golf clubs which are a part of one set of wood golf clubs according to a second embodiment of the present invention. FIG. 2*a* shows a club-head 14*a* of a long wood club having the club-number 1, i.e., a driver for obtaining a long flight distance of a ball, and FIGS. 2*b* and 2*c* show club-heads 14*b* and 14*c* of middle wood clubs having club-numbers 3 and 5, i.e., a spoon and cleek, respectively, for obtaining middle flight distances of balls. Generally, these wood clubs shown in FIGS. 2*a* to 2*c* are a part of one set of five wood golf clubs having varying club-numbers. The set of wood golf clubs may include wood clubs having club-numbers 2 and 4 other than the above-mentioned wood clubs shown in FIGS. 2*a* to 2*c.* In the set of wood golf clubs, each wood club has a club-length which is determined so that the club-length decreases gradually or regularly in accordance with an increase of the club-number.

Referring to FIGS. 2*a* to 2*c,* the club-heads 14*a* to 14*c* of the wood clubs are hollow metal heads, each having therein a closed bore. The club-heads 14*a* to 14*c* have face portions 15*a* to 15*c,* respectively, for hitting a ball, and rear portions 16*a* to 16*c.* Each of the club-heads 14*a* to 14*c* is made of a stainless steel by a lost-wax process. The material of each of the face portions 15*a* to 15*c* of the club-heads 14*a* to 15*c* is then changed into a springy material having a high elasticity by an annealing treatment applied thereto.

As apparent from FIGS. 2*a* to 2*c,* the face portions 15*a* to 15*c* of the club-heads 14*a* to 14*c* have thicknesses which are determined so that the thicknesses decrease gradually or regularly, for example, 5 mm, 3 mm, and 2 mm, in accordance with the increase in the club-length or decrease in the club-number. Therefore, the elasticities of the face portions 15*a* to 15*c* of the club-heads 14*a* to 15*c* increase in accordance with the increase of the club-length. As the result, the time that the club-heads 14*a* to 15*c* are in contact with the ball during impact therebetween becomes longer in accordance with the increase in the club-length.

Further, according to the above-mentioned construction of the set of wood clubs, it becomes possible to increase the weights of the rear portions 16*a* to 16*c* gradually or regularly in accordance with the decrease of the thicknesses of the face portions 15*a* to 15*c* of the club-heads 15*a* to 15*c*, while keeping the total weight of the club-heads 14*a* to 14*c* the same as that of the conventional wood club-heads, respectively. Therefore, it becomes possible to gradually increase the depths of the positions of the centers of gravity of the club-heads 14*a* to 14*c* from the face surfaces of the club-heads 14*a* to 14*c* in accordance with the increase in the club-lengths. Consequently, moments of inertia of the club-heads about the centers of gravity thereof in the club-heads 14*a* to 14*c* increase gradually in accordance with the increase in the club-lengths. As a result, when the ball is hit by a club-head of a long wood club such as a number of 1 or 2 club at a point which is deviated from a sweet spot of the club-head, it becomes possible to prevent a turning of the face portion of the club-head to the left or right, and thus it becomes easy to cause the ball to fly in a objective direction.

Figure 3:
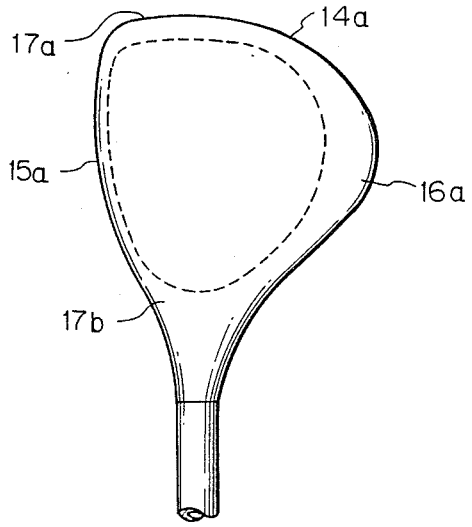
FIG. 3 is a plane view of the club-head of the golf club shown in FIG. 2*a;*

FIG. 3 shows a plane view of the club-head 14*a* shown in FIG. 2*a*. As shown in FIG. 3, the face portion 15*a* of the club-head 14*a* is integrally connected to toe and heel portions 17*a* and 17*b* thereof. The thickness of the toe and heel portions 17*a* and 17*b* is larger than that of the face portion 15*a* of the club-head 14*a*, and the inner and outer surfaces of the face portion 15*a* are smoothly connected to the toe and heel portions 17*a* and 17*b* so that the thickness of the club-head 14*a* increases gradually at both connecting portions between the face portion 15*a* and the toe and heel portions 17*a* and 17*b*. According this construction of the club-head, it becomes possible to increase the strength of the club-head while maintaining a high elasticity of the face portion of the club-head.

Figure 5:
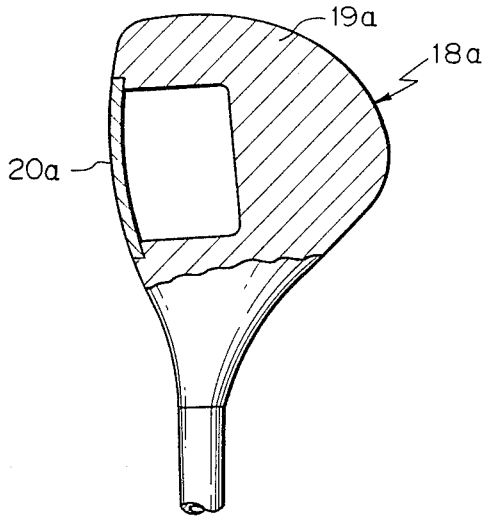
FIG. 5 is a plane view, with partial cross-section, of the club-head of the golf club shown in FIG. 4*a.*
Figure 4A:
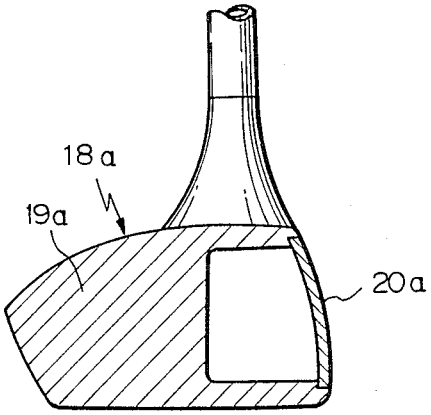
FIGS. 4*a* to 4*c* are cross-sectional views illustrating club-heads of wood-type gold clubs, respectively, which are a part of one set of wood-type golf clubs according to a third embodiment of the present invention.
Figure 4B:
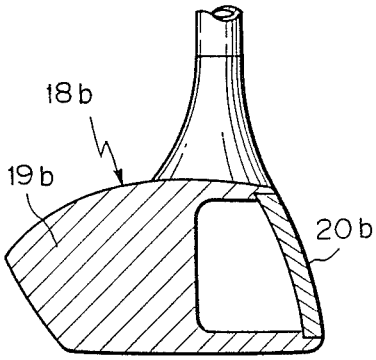
Figure 4C:
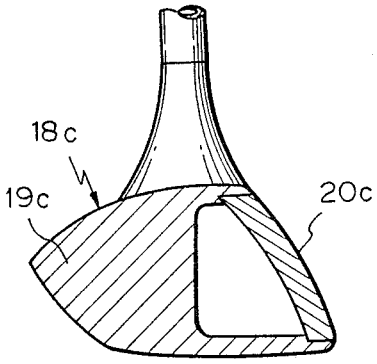

FIGS. 4*a* to 4*c* show club-heads 18*a* to 18*d* of wood golf clubs which are a part of one set of wood golf clubs according to a third embodiment of the present invention. The club-numbers and club-lengths of the wood clubs shown in FIGS. 4*a* to 4*c* are the same as those shown in FIGS. 2*a* to 2*c*. The club-head 18*a* is also shown in FIG. 5.

Referring to FIGS. 4*a* to 4*c*, and 5, the club-heads 18*a* to 18*c* of the wood clubs comprise bodies 19*a* to 19*c*, respectively, each made of a wood such as a persimmon. The bodies 19*a* to 19*c* have therein bores, each open to the faces thereof, respectively. The club-heads 18*a* to 18*c* comprise face plates 20*a* to 20*c*, respectively, for hitting a ball. The face plates 20*a* to 20 are fitted into and secured to the bodies 19*a* to 19*c* and close the bores thereof, respectively. Thus, the face plates 20*a* to 20*c* form face portions of the club-heads 18*a* to 18*c*, respectively. Each of the face plates 20*a* to 20*c* is made of a springy material such as a spring steel. As apparent from FIGS. 4*a* to 4*c*, the face plates 20*a* to 20*c* have thicknesses which are determined so that the thicknesses decrease gradually or regularly in accordance with the increase in the club-length or decrease in the club-number. Therefore, the elasticities of the face plates 20*a* to 20*c* of the club-heads 18*a* to 18*c* increase in accordance with the increase in the club-lengths. As the result, the times that the club-heads 18*a* to 18*c* are in contact with the ball during an impact therebetween become longer in accordance with the increase of the club-lengths, as in the above-mentioned second embodiment.

While particular embodiments shown in the Figures and disclosure of the present invention have been described, it will be understood, of course, that the present invention is not limited thereto, since modifications can be made by those skilled in the art in the light of the foregoing teachings. For example, in the set of golf clubs with hollow metal heads as shown in FIGS. 1*a* to 1*d* and 2*a* to 2*c*, the face portion and the rest of each of the club-heads may be made of a different material and then secured together. Further, the thicknesses of the face portions of the club-heads may increase at a constant or nonconstant ratio in accordance with the increase of the club-lengths.

I claim:

1. A set of golf clubs each having a shaft with a different length and a club-head attached to said shaft, each of said club-heads having a front wall at a different loft for hitting a golf ball and a closed hollow space formed in said club head immediately behind said front wall, each front wall of each club-head having a resiliency greater than the resiliency of the remaining portion of said club-head and also having a uniform thickness, the front walls of said club-heads having different thicknesses such that the thickness gradually decreases in accordance with the gradual increase in the length of said shafts.

2. A set of golf clubs according to claim 1, wherein each of said club-heads having said front wall is made of stainless steel, and only each of said front walls of said club-heads has characteristics corresponding to those resulting from being subjected to an annealing treatment so as to have a resiliency greater than the resiliency of the remaining portion of said club-head.

3. A set of golf clubs according to claim 1, wherein each club-head has a body, each body having a front side and a recess formed in said front side, and each front wall is made of a springly plate member having a resiliency greater than the resiliency of said body and secured to said front side of said body in a manner such that said recess of said body is covered by said front wall so as to define a closed hollow behind said front wall.

4. A set of golf clubs according to claim 3, wherein said bodies of said club-heads are made of wood.

* * * * *